US009335659B2

(12) United States Patent
Sakamaki

(10) Patent No.: US 9,335,659 B2
(45) Date of Patent: May 10, 2016

(54) IMAGE FORMING APPARATUS WITH REPLENISHMENT TONER CONTAINER WHICH HOUSES TONER TO WHICH EXTERNAL ADDITIVES ARE ADDED

(71) Applicant: CANON KABUSHIKI KAISHA, Tokyo (JP)

(72) Inventor: Tomoyuki Sakamaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/677,864

(22) Filed: Apr. 2, 2015

(65) Prior Publication Data

US 2015/0293473 A1 Oct. 15, 2015

(30) Foreign Application Priority Data

Apr. 9, 2014 (JP) ..... 2014-080136

(51) Int. Cl.
*G03G 15/08* (2006.01)

(52) U.S. Cl.
CPC ..... *G03G 15/0865* (2013.01); *G03G 15/0832* (2013.01); *G03G 15/0877* (2013.01); *G03G 15/0879* (2013.01); *G03G 2215/0129* (2013.01)

(58) Field of Classification Search
CPC ..... G03G 15/0865; G03G 15/0832
See application file for complete search history.

(56) References Cited

U.S. PATENT DOCUMENTS 5,272,040 A * 12/1993 Nakasawa ..... G03G 9/0825 430/108.6
2003/0170046 A1* 9/2003 Sato ..... G03G 15/0894 399/109
2008/0118256 A1* 5/2008 Playfair ..... G03G 15/5033 399/27
2011/0013945 A1* 1/2011 Hatakeyama ..... G03G 15/0848 399/259

FOREIGN PATENT DOCUMENTS

JP 61-228460 A 10/1986
JP 7-319200 A 12/1995
JP 3074110 B2 8/2000
JP 2006-337699 A 12/2006
JP 2009151120 A * 7/2009
JP 4920908 B2 4/2012

* cited by examiner

*Primary Examiner* — David Gray
*Assistant Examiner* — Laura Roth
(74) *Attorney, Agent, or Firm* — Fitzpatrick, Cella, Harper and Scinto

(57) ABSTRACT

An image forming apparatus includes: a replenishment toner container which houses toner; and a development device which forms an image by using the toner supplied from the replenishment toner container. At least two types of external additives are added to the toner. Of the two types of external additives, when an added amount of a first external additive is Wh (volume % with respect to the toner) and an added amount of a second external additive is Wl (volume % with respect to the toner), a value of Wh+Wl in initial toner of a developer housed in the development device in advance is larger than a value of Wh+Wl in replenishment toner of a developer housed in the replenishment toner container. The fluidity of the replenishment toner is higher than the fluidity of the initial toner.

6 Claims, 6 Drawing Sheets

*FIG. 5*

| | INITIAL PERIOD | ELAPSE OF USED TIME WITH 2% | ELAPSE OF USED TIME WITH 40% |
|---|---|---|---|
| | CONVEYANCE CAPABILITY | AGGREGATE | Q／M |
| EXAMPLE 1 | ○ | ○ | Δ5μC |
| EXAMPLE 2 | ○ | ○ | Δ3μC |
| COMPARATIVE EXAMPLE 1 | ○ | × | Δ9μC |
| COMPARATIVE EXAMPLE 2 | × | ○ | Δ14μC |
| COMPARATIVE EXAMPLE 3 | ○ | ○ | Δ18μC |
| COMPARATIVE EXAMPLE 4 | ○ | × | Δ2μC |

IMAGE FORMING APPARATUS WITH REPLENISHMENT TONER CONTAINER WHICH HOUSES TONER TO WHICH EXTERNAL ADDITIVES ARE ADDED

BACKGROUND OF THE INVENTION

1. Field of the Invention

The present invention relates to an image forming apparatus that forms a toner image by using a developer acquired by adding an external additive to toner.

2. Description of the Related Art

Conventionally, as toner used for an image forming apparatus, in order to provide fluidity, toner to which a fluidizing agent such as silica, titania, or alumina is added is used. When the fluidizing agent (hereinafter, referred to as an "external additive") such as silica is added, the fluidity of the developer can be configured to be appropriate, and the generation of toner aggregates, deterioration of the image quality, and the like accompanied with a decrease in the fluidity can be suppressed.

However, as the period of the use increases, the external additive attached to the toner surface receives a share accompanied with stirring or conveyance in a development device, and there is concern that the external additive is gradually separated from the toner or is buried in the toner surface. It is difficult to completely prevent such degradation, and it is predicted that the degradation will becomes more marked in the ongoing trend of increasing the speed of the image forming apparatus. When the degradation occurs, the fluidity providing function of the external additive disappears, and there is concern of aggregates being generated, the image quality being degraded, and the like. Such a problem may easily occur particularly for a low image ratio at which the amount of consumption of the toner is small. The reason for this is as follows.

Generally, in an image forming apparatus, a method is widely used in which toner of a predetermined amount is input to a development device in advance, and, when the toner is consumed for forming an image, toner of an amount corresponding to a decrease is supplied. In such a case, even when toner disposed inside the development device is degraded, the toner disposed inside the development device is gradually replaced with new toner in the process of consuming the toner and newly supplying toner. Accordingly, the degradation of the toner can be suppressed. However, in a case where the amount of consumption of the toner is small, new toner is not supplied that much, and the toner is not replaced with new toner. In such a case, since the toner stays in the development device for a long time, the degradation of the toner may easily progress.

In order to deal with such a problem, an image forming apparatus having a mode for forcibly consuming toner at a time other than the time of forming an image in a case where the amount of consumption of the toner is small has been proposed and used (for example, see Japanese Patent Laid-Open No. 2006-337699). In such a configuration, in a case where the amount of consumption of the toner is determined to be small, the toner is additionally consumed in a forced manner, and accordingly, also degraded toner is gradually replaced with new toner, whereby a reduction in the degradation is suppressed.

However, in such a configuration, a time is required for forcibly consuming the toner at a time other than the time of forming an image. For this reason, there is a problem in that a down time increases for a user. In addition, since toner is unnecessary consumed, there is a problem in terms of cost.

Accordingly, a configuration in which such forced consumption of toner does not need to be performed is desirable.

As a countermeasure that can be performed without forcibly consuming the toner as described above, a configuration in which a large amount of an external additive is added to the toner in advance may be considered. In a case where a large amount of the external additive is added in advance, even when the external additive is gradually separated as the used time elapses, there is a delay until the external additive completely disappears. Accordingly, the fluidity providing function of the external additive can be maintained for a longer time. As a result, the occurrence of a problem such as degradation of the image quality accompanied with a reduction in the fluidity can be suppressed.

However, also in such a configuration, there are the following problems. In order to acquire a satisfactory effect from the configuration described above, while it is necessary to increase the amount of the external additive, on the other hand, in a case where the amount of the external additive of toner is increased, there is concern that the fluidity becomes too high particularly in the initial period. While low fluidity of toner causes a problem, in a case where the fluidity of toner is excessively high, other problems occur such as a reduction in the conveyance capability of a developer on a developing sleeve. For this reason, it is necessary to suppress the fluidity of the initial period to be in an appropriate range to some degree. Accordingly, practically, there is an upper limit of the amount of the external additive to be added to toner in advance.

The above-described problem is originated from that toner (hereinafter, referred to as "initial toner") put into a developing container in the initial period and toner (hereinafter, referred to as "replenishment toner") supplying a consumed amount are toner of the same kind. Thus, a proposal for resolving the above-described problem by changing the external added amount between the initial toner and the replenishment toner has been made (see Japanese Patent Laid-Open No. S61-228460 and H7-319200).

In Japanese Patent Laid-Open No. S61-228460 and H7-319200, configurations have been proposed in which the external added amount of the replenishment toner is increased with respect to the external added amount of the initial toner. Since the external added amount of the replenishment toner is increased, as described above, even when the external additive is gradually separated according to the elapse of the used time, it is possible to maintain the fluidity providing function of the external additive for a longer time. For this reason, degradation of the image quality that is accompanied with a decrease in the fluidity can be suppressed. On the other hand, since the amount of the external additive in the initial toner is suppressed to be small, like the case described above, there is no concern that the fluidity becomes too high in the initial period. Accordingly, a decrease in the fluidity after an elapse of the used time can be suppressed while the level of the fluidity of the initial period is suppressed within an appropriate range.

However, by increasing the amount of the external additive of the replenishment toner as in the above-described configuration, in the case of a high image ratio at which the amount of consumption of the toner is large, there is concern that a new problem as represented below is caused.

In the process of consuming the toner and supplying new toner, some of the external additive added to the toner is peeled off to fall in the development device. When a large amount of the external additive peeled off to fall as above is accumulated in the development device, various properties of the toner are influenced thereby. The external additive has influences on the charged level and the environment dependency of the toner and the like in addition to the fluidity provision. For this reason, when a large amount of the external additive is accumulated, there is concern that there is a problem in the stability through the elapse of the used time such as the charged level and the environment dependency of the toner.

In addition, in a case where a two-component developer in which a carrier is mixed together with toner is used, when a large amount of the external additive is accumulated, the external additive transits to the carrier. Then, there is a possibility that the charged level of the toner according to the carrier is influenced. Such a problem according to the accumulation of the external additive becomes remarkable at a high image ratio at which the amount of consumption of the toner is large. The reason for this is that the amount of the external additive peeled off to fall increases as a larger amount of toner is supplied by the development device.

As above, in a case where the amount of the external additive in the supply toner is increased so as to solve the problem of a decrease in the fluidity at a low image ratio, the problem of the accumulation of the external additive at a high image ratio becomes remarkable.

As a countermeasure for the above-described problem, it may be considered to suppress the accumulation of the external additive at a high image ratio by decreasing the amount of the external additive in the same way by improving the fluidity providing function of the external additive. However, in a case where the added amount of the external additive in the initial toner is small, there is concern as described below.

As described above, in a case where a large amount of the external additive is added, even when the external additive is gradually separated as the used time elapses, there is a delay in time until the external additive completely disappears. For this reason, the fluidity providing function of the external additive can be maintained for a long time. Conversely, in a case where the amount of the added external additive is small, particularly, at a low image ratio, the external additive is gradually separated as the used time elapses, and there is no delay in the time until the external additive completely disappears. Thus, there is concern that the image is degraded according to a decrease in the fluidity at a low image ratio.

In a case where the image ratio used by a user is known in advance, the problems described above can be responded by adjusting the amount of the external additive. However, since the image ratio for a user is not known in advance, and, practically, the use method differs much depending on the user, it is not possible to practically respond to an individual case.

SUMMARY OF THE INVENTION

It is desirable to maintain fluidity of a developer while the accumulation of an external additive inside the developer at the time of forming an image having a high image ratio according to an elapse of the used time is suppressed.

A representative configuration of the present invention is an image forming apparatus comprising: a replenishment toner container which houses toner; and a development device which forms an image by using the toner supplied from the replenishment toner container, wherein at least two types of external additives are added to the toner, wherein, of the two types of external additives, when an added amount of a first external additive is Wh (volume % with respect to the toner) and an added amount of a second external additive is Wl (volume % with respect to the toner), a value of Wh+Wl in initial toner of a developer housed in the development device in advance is larger than a value of Wh+Wl in replenishment toner of a developer housed in the replenishment toner container; and wherein the fluidity of the replenishment toner is higher than the fluidity of the initial toner.

Further features of the present invention will become apparent from the following description of exemplary embodiments with reference to the attached drawings.

BRIEF DESCRIPTION OF THE DRAWINGS

FIG. 5 is a table that compares experimental results of examples and comparative examples.

DESCRIPTION OF THE EMBODIMENTS

Hereinafter, an embodiment of the present invention will be described in detail with reference to the drawings. In this embodiment, with respect to initial toner, the fluidity of replenishment toner is increased while a total amount of an external additive in the replenishment toner is decreased. For this reason, under such a restriction, another embodiment in which a part or the whole of the configuration of the embodiment is replaced with a substitutive configuration may be employed. Thus, an image forming apparatus that supplies toner may be used. For example, the image forming apparatus may be used regardless of a tandem-type, a one-drum type, an intermediate transfer type, or a direct transfer type. In addition, a developer may be used regardless of being a two-component developer or a one-component developer.

In this embodiment, while main portions relating to the formation of a toner image will be described, the present invention may be performed for various uses such as a printer, various printers, a copying machine, a facsimile, a multifunction device.

<Image Forming Apparatus>

Figure 1:
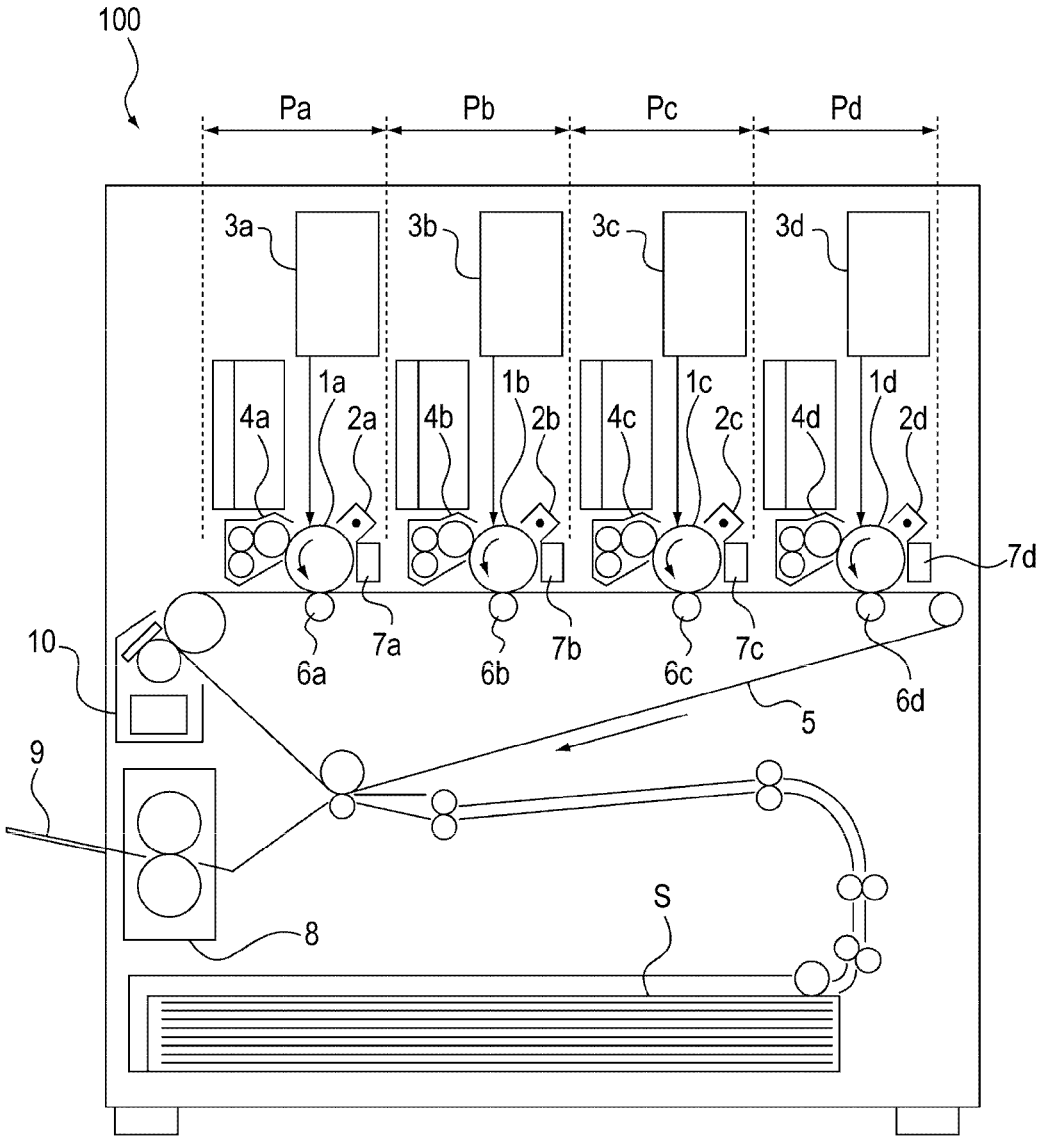
FIG. 1 is a schematic diagram that illustrates the configuration of an image forming apparatus.

A schematic configuration of the image forming apparatus will be described with reference to FIG. 1. FIG. 1 is a schematic diagram that illustrates the configuration of the image forming apparatus. As illustrated in FIG. 1, the image forming apparatus 100 is a full-color printer of the tandem-type intermediate transfer system having image forming portion P (Pa, Pb, Pc, and Pd) of colors along an intermediate transfer belt 5. A plurality of image forming portions of chromatic colors is arranged together with image forming portions of achromatic colors along an intermediate transfer medium.

The image forming portions P (Pa, Pb, Pc, and Pd) house toner of mutually-different four colors (yellow, magenta, cyan, and black). Thus, while the colors of toner images that are formed are different from each other, the configurations of the image forming portions P are the same. For this reason, a, b, c, and d posted at the ends of reference signs represented in FIG. 1 will be omitted in the following description except for a particularly necessary case.

The toner images formed on photosensitive drums 1 of the image forming portions P are primarily transferred onto an intermediate transfer belt 5. The toner images of colors formed in the four image forming portions P are transferred onto the intermediate transfer belt 5 in a sequentially superimposed manner.

The toner images of the four colors that are primarily transferred onto the intermediate transfer belt 5 are conveyed to a secondary transfer portion and are secondarily transferred onto a recording material S altogether. After the toner images are fixed on the surface of the recording material S onto which the toner images of the four colors are secondarily transferred by receiving heat and pressure from a fixing device 8, the recording material S is discharged to a stack tray 9.

Each image forming portion P includes: a corona charger 2; an exposure device 3; a development device 4; a primary transfer roller 6; and a cleaning device 7 on the periphery of the photosensitive drum 1. Hereinafter, each portion will be described in detail.

The photosensitive drum 1 is acquired by forming a photosensitive layer having a negative charging property on the outer circumferential face of an aluminum cylinder and rotates in the direction of a corresponding arrow at a process speed of 273 mm/sec. The corona charger 2 irradiates the photosensitive drum 1 with charged particles accompanied with corona discharging and charges the surface of the photosensitive drum 1 at uniform electric potential of negative polarity. The exposure device 3 emits laser beams that are modulated to be on/off in accordance with scanning line image data in which a color separation image of an image forming target color is expanded by using a rotary mirror, thereby writing an electrostatic image of the image on the surface of the charged photosensitive drum 1.

The development device 4 stirs a two-component developer having a magnetic carrier and non-magnetic toner as its major compositions and charges the magnetic carrier with positive polarity and charges the non-magnetic toner with negative polarity. The charged two-component developer is carried in a developing sleeve rotating on the periphery of a fixed magnetic pole and slides on the photosensitive drum 1. By applying an oscillation voltage acquired by superimposing an AC voltage on a DC voltage having negative polarity to the developing sleeve, toner charged with negative polarity moves to the electrostatic image formed on the photosensitive drum 1 that has positive polarity relative to the developing sleeve, whereby the electrostatic image is reversely developed.

The primary transfer roller 6 forms a primary transfer portion between the photosensitive drum 1 and the intermediate transfer belt 5 by pressing the intermediate transfer belt 5. By applying a DC voltage having positive polarity to the primary transfer roller 6, the toner image having negative polarity, which is carried on the photosensitive drum 1, is primarily transferred onto the intermediate transfer belt 5 passing through the primary transfer portion.

The cleaning device 7 causes a cleaning blade to slide on the photosensitive drum 1, thereby collecting transfer residual toner remaining on the photosensitive drum 1 by avoiding a primary transfer for the intermediate transfer belt 5. A transfer belt cleaning device 10 collects transfer residual toner remaining on the intermediate transfer belt 5 by avoiding a secondary transfer for the recording material S.

<Development Device>

Figure 2:
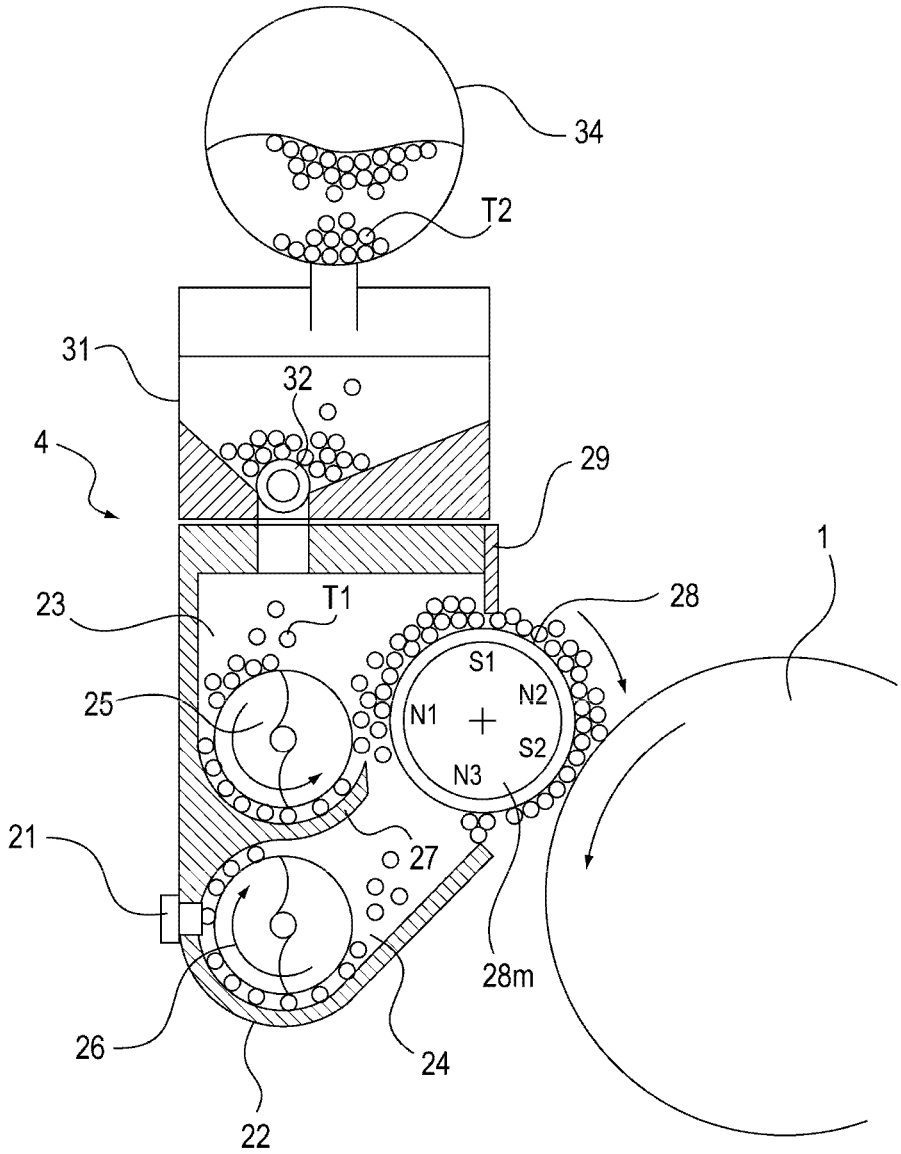
FIG. 2 is a side cross-sectional view that illustrates the appearance of supplying toner to a development device.
Figure 3:
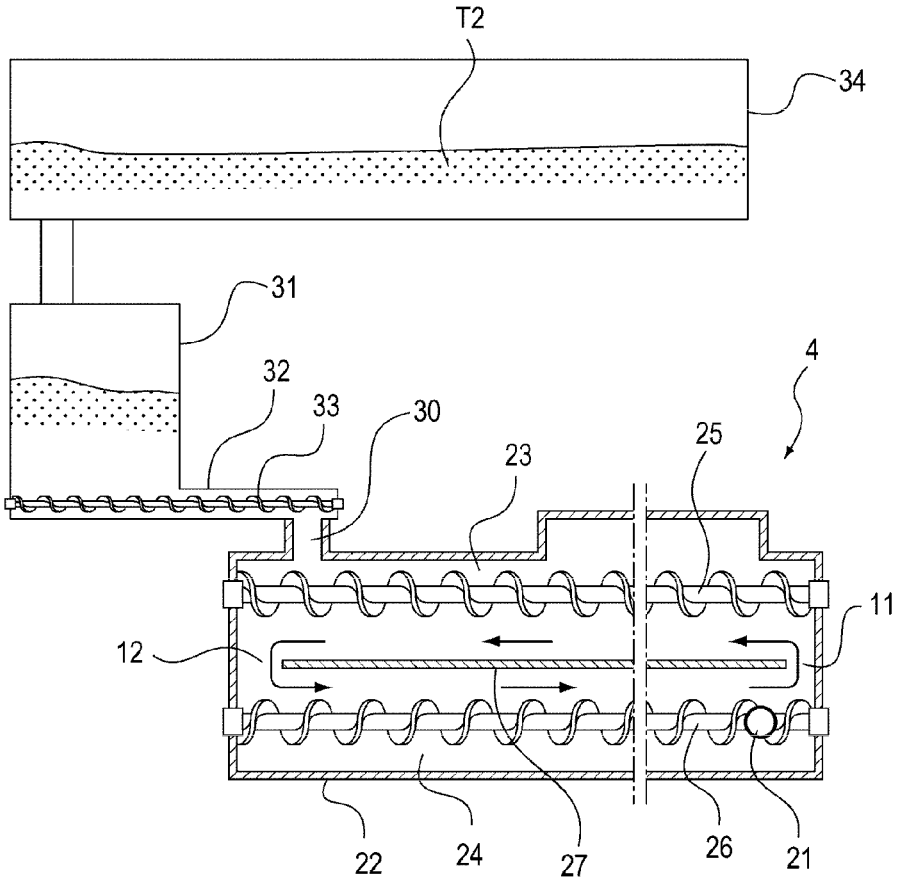
FIG. 3 is a longitudinal cross-sectional view that illustrates the appearance of supplying toner to the development device.

The configuration of the development device will be described with reference to FIGS. 2 and 3. FIG. 2 is a side cross-sectional view that illustrates the appearance of supplying toner to the development device. FIG. 3 is a longitudinal cross-sectional view that illustrates the appearance of supplying toner to the development device.

As illustrated in FIGS. 2 and 3, the development device 4 includes a developing container 22, and a two-component developer containing non-magnetic toner and a magnetic carrier is housed inside the developing container 22 as a developer. In addition, a developing sleeve 28 (developer carrier) and a regulation member 29 that regulates ears of the developer carried on the developing sleeve 28 are included inside the developing container 22.

The inside of the developing container 22 is partitioned into a developing chamber 23 and a stirring chamber 24 by a partition wall 27 having its approximately center portion to extend in a direction perpendicular to the sheet surface. The developer is housed in the developing chamber 23 and the stirring chamber 24.

In addition, the developing container 22 includes two rotating members that stir and convey the developer. The two rotating members are a first conveyance screw 25 (supply stirring member) arranged in the developing chamber 23 and a second conveyance screw 26 (collection stirring member) arranged in the stirring chamber 24. The first conveyance screw 25 and the second conveyance screw 26 are arranged to be approximately parallel with each other.

The first conveyance screw 25 rotates in the direction (counterclockwise direction) of an arrow represented in FIG. 2, thereby conveying the developer disposed inside the developing chamber 23 in one direction along the direction of the axial line. In addition, the second conveyance screw 26 rotates in the direction (clockwise direction) of an arrow represented in FIG. 2 together with the first conveyance screw 25, thereby conveying the developer disposed inside the stirring chamber 24 in a direction opposite to that of the first conveyance screw 25.

As above, the developer is conveyed in accordance with the conveyance according to the rotation of the first conveyance screw 25 and the second conveyance screw 26. In this way, the developer is circulated between the developing chamber 23 and the stirring chamber 24 with opening portion 11 and opening portion 12 disposed at both ends of the partition wall 27 being used as communication portions.

As illustrated in FIG. 2, in a developing area of the developing container 22 that faces the photosensitive drum 1, an opening portion is present, and, in this opening portion, the developing sleeve 28 is arranged to be rotatable and partly exposed in the direction of the photosensitive drum 1. The developing sleeve 28 supplies the developer from the opening portion to the photosensitive drum 1.

Here, the diameter of the developing sleeve 28 is 20 mm, and the diameter of the photosensitive drum 1 is 80 mm. In addition, closest areas of the developing sleeve 28 and the photosensitive drum 1 form a distance of about 400 μm. In this way, in a state in which the developer conveyed to the development device 4 is in contact with the photosensitive drum 1, a developing process is performed.

In addition, the developing sleeve 28 is formed using a non-magnetic material such as aluminum or stainless steel, and, on the inside thereof, a magnet roller 28*m* (magnetic field generating member) is disposed in a non-rotating state. The magnet roller 28*m* according to this embodiment has five magnetic poles. The magnetic poles include a developing pole S2 arranged at a position facing the photosensitive drum 1, a magnetic pole S1 arranged to face the regulation member 29, a magnetic pole N2 arranged between the magnetic pole S1 and the developing pole S2, a magnetic pole N1 facing the developing chamber 23, and a magnetic pole N3 facing the stirring chamber 24.

The developing sleeve 28 rotates in the direction of an arrow (clockwise rotation) represented in FIG. 2 at the time of performing the developing process, thereby carrying the developer supplied from the developing chamber 23. The developer carried on the developing sleeve 28 forms a magnetic brush on the developing sleeve 28 by being applied with a magnetic field, and the magnetic brush is ear-cut by the regulation member 29. The two-component developer of which the layer thickness is regulated in this way is conveyed to the developing area that faces the photosensitive drum 1.

In this embodiment, the regulation member 29 that is in a blade shape is configured by a non-magnetic member formed using aluminum of a plate shape extending along the longitudinal axial line of the developing sleeve 28. As illustrated in FIG. 2, the regulation member 29 is arranged on the further upstream side of the developing sleeve 28 than the photosensitive drum 1.

Then, as described above, both the toner and the carrier of the developer pass between the tip end portion of the regulation member 29 and the developing sleeve 28 and are sent to the developing area. Here, by adjusting a gap between the regulation member 29 and the surface of the developing sleeve 28, the ear-cut amount of the developer magnetic brush carried on the developing sleeve 28 is regulated, and the amount of the developer conveyed to the developing area is adjusted. In this embodiment, the developer coating amount per unit area on the developing sleeve 28, which is regulated by the regulation member 29, is 30 mg/cm$^2$.

<Developing Method>

The developer disposed on the developing sleeve 28 is conveyed to the developing area facing the photosensitive drum 1 in accordance with the rotation of the developing sleeve 28. Here, the developer actualizes an electrostatic latent image formed on the photosensitive drum 1 as a toner image through a developing process using the toner contained in the two-component developer.

At this time, in order to improve the toner providing ratio for the electrostatic latent image, a developing bias voltage in which a DC voltage and an AC voltage overlap each other by using a power supply is applied to the developing sleeve 28. In this embodiment, a DC voltage of −500 V and an AC voltage of which the peak-to-peak voltage Vpp is 1800 V, and of which the frequency f is 12 kHz are applied.

When the toner is consumed as the two-component developer is provided for the developing process, the toner contained in the two-component developer inside the developing container 22 gradually decreases. Here, when the toner excessively decreases, there is concern that a normal image forming process may be started to be disturbed. Thus, in the development device 4, as illustrated in FIGS. 2 and 3, a toner density sensor 21 is disposed. By acquiring the toner density using the toner density sensor 21, the toner density (T/D) of the developer formed by the toner and the carrier can be controlled to be in a predetermined range.

The toner density control, for example, is performed by using a change in the permeability of the developer, and there is a method in which the permeability of the developer is detected by using the toner density sensor 21, and the toner is supplied to the development device 4 according to an output value of the toner density sensor 21. For the supply of toner, toner corresponding to the amount of consumption of the toner is supplied to the development device 4 from a hopper 31 for toner replenishment, which is disposed on the upper side of the development device 4.

On the upper side of the hopper 31, a replenishment toner bottle 34 (replenishment toner container) containing replenishment toner T2 for the development device 4 is disposed. The replenishment toner bottle 34 supplies the replenishment toner T2 such that the toner included inside the hopper 31 is constantly a predetermined amount or more.

A conveyance pipe 32 communicates with a toner supply port 30 of the development device 4 through an opening portion disposed on the lower side of the hopper 31. For this reason, the replenishment toner T2 is supplied from the hopper 31 to the development device 4 through the conveyance pipe 32. The replenishment toner T2 is mixed with the initial toner T1 that is housed inside the development device 4 from the start. The initial toner T1 and the replenishment toner T2 will be described later in detail.

From the lower portion of the hopper 31 across the conveyance pipe 32, a replenishment toner conveyance member 33, which is rotatable, having a blade of a spiral-shape is disposed. By driving the replenishment toner conveyance member 33 as is necessary, toner is supplied from the hopper 31 to the development device 4.

The toner supply port 30 of the development device 4 that is connected to the conveyance pipe 32 of the replenishment toner, as illustrated in FIG. 3, is connected to a position of the developing chamber 23 of the development device 4 that is located on the downstream side in the developer conveying direction. The toner supplied to the position is conveyed to the stirring chamber 24 through the opening portion 12 and then, is stirred and mixed with the developer contained in the developing container 22 while being conveyed in the stirring chamber 24. In this process, the replenishment toner that is in a non-charged state at the time of supply is stirred with the carrier contained in the developer and is charged through friction. In this way, the replenishment toner is in a developable state and is provided for a developing process.

In order to stabilize the electric charging of the replenishment toner, the stirring process of the replenishment toner as described above is necessary. However, in this process, not only the replenishment toner but also the toner that is originally present inside the developing container 22 is stirred. For this reason, when the toner stays in the development device 4 for a long period, the toner continuously receives a share accompanied with the stirring or the conveyance. The share for the toner occurs also in the process of being conveyed on the developing sleeve 28 while regulated by the regulation member 29 in addition to the stirring process using the first conveyance screw 25 and the second conveyance screw 26.

When such sliding friction is received, the external additive that is added to the toner in advance is gradually separated from the toner or is buried on the toner surface. As described above in the background section, generally, in order to provide fluidity, a fluidizing agent such as silica, titania, or alumina is added to the toner. In a case where the external additive is peeled off to fall, the fluidity of the developer is lowered, and there is a possibility that a problem of the generation of toner aggregates, degradation of the image quality, or the like occur.

By simply increasing the external additive as the countermeasure described above, it is possible to have a delay in the time until the external additive is completely peeled off to fall. However, as described in the background section, the fluidity of the initial period becomes too high, and there is concern that other problems such as a decrease in the developer conveyance capability on the developing sleeve occur.

In addition, as described above, when the toner receives a share while the developer is stirred or conveyed in the development device, the external additive is gradually peeled off to fall, and accordingly, the external additive is gradually accumulated in the developing container. However, in a case where the external additive is simply increased, the accumulated amount is increased as well. In this way, when a large amount of the external additive is accumulated, there is concern for the stability through an elapse of used time such as a charged level and the environment dependency of the toner. Thus, in this embodiment, a configuration as below is employed.

The above-described problems are originated from that an initial developer put into the developing container in the initial period in advance and a replenishment developer supplying a consumed amount have the same amount of the external additive. Thus, in this embodiment, by changing the external added amount between the initial developer and the replenishment developer, the above-described problems are solved.

As disclosed in Japanese Patent Laid-Open Nos. 61-228460 and 7-319200, in a case where the external additive of the replenishment toner is increased with respect to the external additive of the initial toner, there is concern that the amount of the external additive accumulated in the developing container is increased. Thus, in this embodiment, the amount of the external additive contained in the replenishment toner is decreased with respect to the amount of the external additive of the initial toner.

However, in a case where the amount of the external additive of the replenishment toner is simply decreased with respect to the amount of the external additive of the initial toner, a decrease in the fluidity of the replenishment toner occurs, and there is concern for the degradation of the image quality that is accompanied with a decrease in the fluidity according to an elapse of the used time. On the other hand, in order to secure the fluidity of the replenishment toner, in a case where the amount of the external additive is increased with the external additive of the replenishment toner being maintained to be smaller than that of the initial toner, the fluidity of the initial toner is improved, and accordingly, there is concern for a defect in the developing sleeve conveyance capability according to excessively high fluidity and the like.

In addition, in a situation in which the fluidity of the initial period is high as described above, and the fluidity after an elapse of the used time is low, there is concern that a change in the fluidity is large. When a change between the fluidity of the initial period and the fluidity after the elapse of the used time becomes large, a change occurs also in the circulation state of the developer according to the change in the fluidity. In such a case, for example, in a case where the balance of the distribution of the amount of the developer in the developing container of the developer is taken by using the fluidity of the initial period, when a decrease in the fluidity occurs after an elapse of the used time, a non-uniform state occurs in the distribution of the amount of the developer in the developing container. As a result, there is concern that a defect in the supply of the developer to the developing sleeve due to lowering of the developer surface, an overflow of the developer from the developing container due to a lift in the developer surface, and the like occur.

In addition, there is concern that the change in the fluidity of the developer has an adverse effect on a result of the detection acquired by the toner density sensor. In a case where the toner density is calculated by predicting the amount of the carrier on the sensor surface by measuring the permeability using the toner density sensor as in this embodiment, when the fluidity of the developer is changed, even in a case where the actual density of the toner is the same, there is a possibility that a different toner density is calculated. When such erroneous detection occurs, it is difficult to maintain the toner density to be constant.

The above-described problem is originated from a decrease in the fluidity of the replenishment toner with respect to the initial toner that is caused by simply decreasing the amount of the external additive of the replenishment toner with respect to the initial toner. Thus, in this embodiment, the added amount and the ratio of the external additive are changed between the initial toner and the replenishment toner (high durability toner) by using two types of external additives having mutually-different fluidity providing functions. In this way, a configuration is achieved in which the fluidity of the replenishment toner is increased with respect to that of the initial toner while a total added amount of the external additive of the replenishment toner is decreased with respect to the fluidity of the initial toner. The fluidity of toner in the present application is defined as fluidity of toner and external additives excluding carrier.

By employing such a configuration, since the amount of the external additive of the replenishment toner is decreased with respect to that of the initial toner, and a total amount of the external additive is decreased, the problem due to the accumulation of the external additive can be suppressed. In addition, since the fluidity of the replenishment toner is increased with respect to that of the initial toner, the problem due to a decrease in the fluidity after an elapse of the used time can be suppressed as well. Furthermore, by suppressing the fluidity of the initial toner to be low, the problem due to the fluidity of the initial period being excessively high can be suppressed, and, as a result, a change in the fluidity from the initial period through an elapse of the used time can be suppressed to be smaller. Hereinafter, it will be described in detail.

<Method of Measuring Fluidity of Toner>

Before a detailed configuration of this embodiment is described, a method of measuring the fluidity of toner will be described. In order to measure toner properties (the fluidity and the like) at the time of the initial period at which the carrier and toner are mixed and at the supply time, it is necessary to separate the toner and the carrier of the two-component developer from each other. Accordingly, it may be configured such that the toner contained in the two-component developer is developed, and the developed toner and the remaining carrier are separately collected.

Basically, it is considered that the fluidity of only the toner before the mixing of the toner and the carrier is reflected on the fluidity of the toner of the time at which the separation is made using the above-described method. Thus, the fluidity of only the toner can be measured in a simple manner. In order to perform the above-described operation in a simple manner, the inventors used an electric field separation-type charging amount measurement device manufactured by Etwas Co., Ltd.

While the above-described device is a charging amount measurement device, by causing toner contained in a two-component developer with which an inner sleeve is coated in the process of the measurement to fly to an outer sleeve by using an electric field, the developer can be easily separated into the toner and the carrier. The inventors separated the toner and the carrier from each other with a condition in which an applied voltage is 2 kV, the amount of the developer is 5 g, a time is 120 sec, and a gap between the inner sleeve and the outer sleeve is 5 mm. In a case where a large amount of the toner was required, by repeating the above-described operation, the required amount was acquired.

<Initial Developer>

The initial developer represents a developer that is put into the developing container at the initial period (at the time of start). In this embodiment, a two-component developer formed by initial toner and a magnetic carrier is used as the initial developer. The initial developer may be enclosed in the development device 4 in advance or may be supplied to the development device 4 at the time of initial installation.

As initial toner contained in the initial developer, well-known toner, in other words, toner acquired by dispersing a coloring pigment, a charge control agent, a toner parting agent, and the like in a resin is used.

As the resin used for the initial toner, a resin having fixability such as a polyester resin or a styrene-acrylic resin is used.

As the coloring pigment used for the initial toner, commonly, in a case where the amount of the resin is set as 100 wt %, the coloring pigment having an amount of 2 to 20 wt % is used. As a black (Bk) pigment, for example, carbon black is used, as a yellow (Y) pigment, for example, naphthol yellow is used, as a magenta (M) pigment, for example, Brilliant Carmine 6B is used, and, as a cyan (C) pigment, for example, phthalocyanine blue is used.

In addition, for the purpose of controlling the charging amount of the toner, commonly, in a case where the amount of the resin is set as 100 wt %, the charge control agent having an amount of 0.1 to 10 wt % is used. As the charge control agent, for example, a metal-containing an azo pigment is used.

Furthermore, in a case where toner images transferred onto a predetermined sheet are to be fixed, a toner parting agent used for providing toner parting properties is blended, and, in a case where the amount of the resin is set as 100 wt %, the toner parting agent having an amount of 0.1 to 20 wt % is used. As the toner departing agent, for example, a paraffin or oil-and-fat synthetic wax is used.

The toner acquired by dispersing a coloring pigment, a charge control agent, a toner parting agent, and the like are dispersed in the resin described above may be manufactured by using a well-known method such as a powder pulverizing method or a polymerization method. For example, in the case of the powder pulverizing method, toner components are premixed using a Henschel mixer or the like and, then are kneaded using a kneading apparatus such as a twin extruder, and this kneaded composition material is cooled, then is pulverized, and classified to be toner. The particle diameter of such toner, generally, may be set such that the measurement diameter measure by a Coulter counter is in a range of 4 to 10 μm.

By adding an external additive to the surface of the toner particle described above for the purpose of improving the fluidity, the external additive is attached to the surface of the toner particle, whereby the fluidity is improved.

As the external additive for the purpose of improving the fluidity, the following materials are appropriately used. For example, there are hydrophobized silica and hydrophobized titania acquired by applying a hydrophobic surface treatment to silica, titanium, and alumina each having a particle diameter of about 0.005 to 0.2 μm by using organopolysiloxane, silazane, or the like.

As the external additive, there is a spacer particle having a large particle diameter of about 0.08 to 0.3 μm. By including the spacer particle in the toner particle as the external additive, the transfer efficiency of the toner can be improved. By externally adding the space particle, a contact area between the toner image and the photosensitive surface is decreased, and the toner is easily peeled off from the photosensitive surface. In this way, the transfer efficiency in the toner transfer process can be improved. As the spacer particle, silica, titania, alumina, or the like is commonly used.

As the type of the external additive, commonly, while there is a case where one type is used, as described above, in this embodiment, two types of fluidity providing functions use mutually-different external additives, and accordingly, external additives of at least two or more types are used. As the external additive, two types including the spacer particle may be used, or two or more types may be added to the spacer particle. Furthermore, the spacer particle may not be necessarily used. Also in a case where the spacer particle is not used, two or more types of the external additives need to be added. Details of the added amount of the external additive and the like will be described later.

As the magnetic carrier configuring the two-component developer together with the toner described above, a well-known magnetic carrier such as ferrite or an iron powder is used. The diameter thereof is frequently in the range of 30 to 100 μm. Generally, the magnetic carrier and the toner are mixed at the weight ratio (in terms of the T/D ratio, 5 to 15%) of about 95:5 to 85:15 on the whole, thereby configuring the two-component developer.

<Replenishment Toner>

Figure 4:
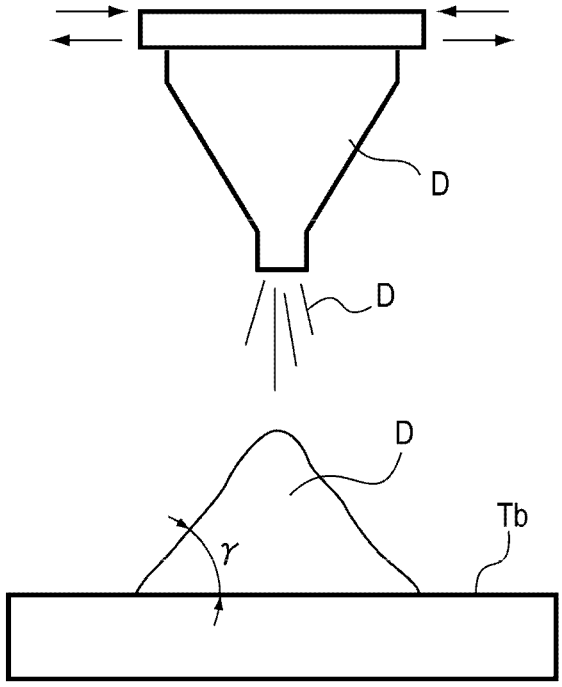
FIG. 4 is a schematic diagram that illustrates a method of measuring an angle of repose and an angle of rupture.

In this embodiment, toner that is supplied in accordance with the consumption of the toner according to the developing process has the same composition as that of the initial toner except that, compared to the initial toner contained in the initial developer, the fluidity is set to be increased while a total amount of the external additive is decreased. The fluidity of the toner described here can be evaluated by measuring the angle of repose. FIG. 4 is a schematic diagram that illustrates a method of measuring an angle of repose and an angle of rupture.

As illustrated in FIG. 4, the angle γ of repose is a maximal inclination angle at which the stability can be maintained without the inclination face spontaneously collapsing when the developer D is deposited on a flat repose angle measurement table Tb. In other words, the angle γ of repose is an angle of a mountain that can be a lower portion when the developer D is shaken off from the upper portion, in other words, a maximal value of the angle represented as γ in FIG. 4. As the fluidity is higher, the inclination face may easily collapse, and the angle γ of repose decreases. To the contrary, as the fluidity is lower, it is difficult for the inclination face to collapse, and the angle γ of repose increases.

Generally, for measuring the angle γ of repose, there is a method using a powder tester. In other words, by using the powder tester, a sieve of 246 μm is set on a vibration table, 250 cc of sample is put therein, and the sieve is vibrated for 180 seconds. The sample is deposited on the repose angle measurement table Tb, and the angle γ of repose of the deposited layer is measured by using an angle measurement arm. Thus, as described above, in order to increase the fluidity of the replenishment toner to be higher than that of the initial toner, the angle γ of repose of the two-component developer generated by using the replenishment toner may be adjusted to be smaller than that of the initial developer.

The fluidity comparison method is not limited to a comparison of toner, and a comparison between developers including toner may be used. In other words, in a case where the two-component developer is used as in this embodiment, the shape of the two-component developer acquired by mixing the toner and the magnetic carrier may be evaluated as well. In such a case, it may be configured such that the replenishment toner and the magnetic carrier are mixed at the same ratio as that of the initial toner and the magnetic carrier contained in the initial developer, and the angle of repose is compared to that of the initial developer.

While absolute values of results acquired from an evaluation using the toner and an evaluation using the two-component developer are different from each other, the magnitude relation between the initial toner and the replenishment toner is not reversed. Thus, in order to increase the fluidity of the replenishment toner to be higher than that of the initial toner, the angle γ of the two-component developer that is generated by using the replenishment toner may be adjusted to be smaller than that of the initial developer.

In this embodiment, the fluidity of the replenishment toner is increased while a total amount of the external additive contained in the initial toner is decreased. Thus, as a unit for this, the added amount and the ratio of the external additive is changed between the initial toner and the replenishment toner by using two types of external additives having mutually-different fluidity providing functions.

The fluidity providing function described here represents a capability for providing the fluidity at the time of adding a predetermined amount of the external additive to the toner and, here, is evaluated as the fluidity at the time of adding the external additive of 1.0 volume % to the toner of 100 volume % before the addition of the external additive. The evaluation of the fluidity is performed by measuring the angle of repose described above.

In addition, in a case where it is difficult to measure the fluidity at the time of adding 1.0 volume %, it is not necessary to adhere to the addition of 1.0 volume %, but, when the added amount at the time of evaluating the fluidity is determined, the fluidity at the time of 1.0 volume %, in other words, the fluidity providing function may be predicted based on the added amount.

In order to evaluate the fluidity providing functions of the two types of the external additives, each toner acquired by adding a corresponding external additive of 1.0 volume % with respect to the toner of 100 volume % to the same toner before the addition of the external additive is prepared. Then, as a result of measuring the angle of repose, an external additive having higher fluidity, in other words, having a smaller angle γ of repose is determined as the external additive having a higher fluidity providing function. In a case where a development system using a two-component developer is used as in this embodiment, two component-developers may be generated with the same T/D ratio using the same carrier and be evaluated as described above.

<Composition of External Additive>

As described above, in this embodiment, the added amount and the ratio of the external additive are adjusted between the initial toner and the replenishment toner by using two types of external additives having mutually-different fluidity providing functions. Accordingly, the fluidity can be increased while a total amount of the external additive of the replenishment toner is decreased. A detailed composition of the external additive for achieving this will be described below.

At least two types of external additives having mutually-different fluidity providing functions are added to the initial toner and the replenishment toner. The fluidity providing function can be evaluated using the above-described method in advance, and the magnitude relation is clarified. Of the two types of the external additives, the added amount of the external additive (first external additive) having a higher fluidity providing function is represented as Wh volume % (the added amount with respect to the toner of 100 volume %). On the other hand, the added amount of the external additive (second external additive) having a lower fluidity providing function is represented as Wl volume % (the added amount with respect to the toner of 100 volume %). In the description presented below, particularly, the added amounts for the initial toner will be respectively denoted by Wh(start) and Wl(start), and the added amounts for the replenishment toner will be respectively denoted by Wh(supply) and Wl(supply).

In this embodiment, a total added amount of the external additive for the replenishment toner is decreased with respect to that of the initial toner. Accordingly, the total added amount (Wh+Wl) is smaller in the replenishment toner than in the initial toner. In other words, Wh(start)+Wl(start)>Wh(supply)+Wl(supply). As above, by decreasing the total amount of the external additive is decreased in the replenishment toner with respect to the initial toner, the accumulation of the external additive can be suppressed. In accompaniment with this, the problems according to the accumulation of the external additive can be suppressed.

In this case, the total added amount of the external additive in the initial toner is larger than that in the replenishment toner. Thus, there is an additional advantage as below. In a case where the use at the low image ratio is continued from the initial period, even when the external additive is gradually separated as the used time elapses, in a case where the added amount of the external additive for the initial toner is large, there is a delay in time until the external additive completely disappears. Accordingly, the fluidity providing function of the external additive can be maintained for a longer time.

Commonly, in a case where the amount of the external additive of the replenishment toner is simply decreased with respect to that of the initial toner, the fluidity of the replenishment toner is lower than that of the initial toner. Thus, in this embodiment, by using external additives of two types having mutually-different fluidity providing functions, the added amounts and the added ratios of the first external additive and the second external additive are changed between the initial toner and the replenishment toner.

In this embodiment, the external addition ratio of the external additive having the higher fluidity providing function in the replenishment toner is relatively higher than that in the initial toner. Here, the ratio of the added amount of the external additive having the higher fluidity providing function to the added amount of the external additive having the lower fluidity providing function is defined as a high fluidity providing external addition ratio (Wh/Wl). In such a case, the high fluidity providing external addition ratio (Wh/Wl) is larger in the replenishment toner than in the initial toner. In other words, Wh(start)/Wl(start)<Wh(supply)/Wl(supply).

As above, in a case where the addition ratio of the external additive having the higher fluidity providing function is relatively high in the replenishment toner, although a total amount of the external additive of the replenishment toner is smaller than that of the initial toner, the fluidity of the replenishment toner can be increased.

In order to set the fluidity of the replenishment toner to be higher than that of the initial toner, while the above-described configuration is necessary, precisely, it cannot be determined that the fluidity of the replenishment toner is necessarily higher than that of the initial toner in a case where the above-described equation is satisfied. The reason for this is that whether the fluidity of the replenishment toner is higher than that of the initial toner delicately depends on not only the ratio of the external additive but also the type and the added amount thereof. However, in a case where the fluidity providing function of each external additive is measured, based on the result thereof, the fluidity of the replenishment toner can be set to be higher than that of the initial toner as below.

First, the fluidity providing function of each of the two types of external additives having mutually-different fluidity providing functions is evaluated. As described above, the fluidity providing function of each external additive can be evaluated by preparing toner acquired by adding the external additive of 1.0 volume % to the toner before external addition of 100 volume % and measuring the angle of repose of the two-component developer mixed with the toner or the magnetic carrier.

In this embodiment, the fluidity providing function is defined as (fluidity providing function)=(the angle of repose of the toner or the two-component developer after the external addition of 1.0 volume %). Thus, the angle of repose of the toner or the two-component developer after the external addition of 1.0 volume % may be measured.

Next, the fluidity of actual toner is evaluated based on the result of the evaluation of the fluidity providing function of each of the two types of external additives. In a case where the fluidity of actual toner is evaluated, the fluidity is influenced by not only the fluidity providing function of each external additive but also an actually added amount thereof. When one external additive is focused, generally, as the added amount of the external additive is increased, the fluidity becomes higher, and the angle of repose tends to be smaller. Accordingly, when the amount of the external additive is increased, the angle of repose is decreased, and thus, it can be determined that the amount of the external additive and the angle of repose are in inverse proportion to each other.

Thus, when the fluidity is to be evaluated, the fluidity providing function (the angle of repose) may be considered as a reciprocal thereof, and, as the reciprocal of the fluidity providing function is larger, the fluidity can be evaluated to be higher. Since the fluidity providing function is defined as the angle of repose of a case where 1.0 volume % is added, in order to estimate the fluidity of the actual toner, the above-described fluidity providing function may be multiplied by the volume % of the external additive that is actually added.

For example, in a case where the external additive of 2.0 volume % is added in the actual toner, the fluidity of the actual toner can be evaluated by multiplying the reciprocal of the fluidity providing function by 2.0. As a value acquired by multiplying the reciprocal of the fluidity providing function by the added amount of the external additive is larger, the fluidity can be evaluated to be higher.

As above, when the fluidity providing function of the external additive and the added amount are known, the fluidity of the actual toner can be evaluated. In a case where two types of external additives are added, by adding values (added amount W/fluidity providing function F) acquired by respectively multiplying the reciprocals of the fluidity providing functions of the external additives by the added amounts, the fluidity can be evaluated.

For example, of the two types of external additives, the fluidity providing function of the external additive having the higher fluidity providing function is represented as Fh, and the fluidity providing function of the external additive having the lower fluidity providing function is represented as Fl. In addition, it is assumed that the added amounts for the initial toner are respectively Wh(start) and Wl(start), and the added amounts for the replenishment toner are respectively Wh(supply) and Wh(supply). In such a case, the fluidity of each of the initial toner and the replenishment toner is as follows.

The fluidity of the initial toner can be represented as (Wh(start)/Fh)+(Wl(start)/Fl), and the fluidity of the replenishment toner can be represented as (Wh(supply)/Fh)+(Wl(supply)/Fl). As this value is larger, the fluidity is determined to be higher.

Thus, the types and the added amounts of the external additives are selected such that the value of (Wh(supply)/Fh)+(Wl(supply)/Fl) is larger than the value of (Wh(start)/Fh)+(Wl(start)/Fl). Accordingly, the fluidity of the replenishment toner is higher than that of the initial toner.

As in the configuration described above, by setting the fluidity of the replenishment toner to be higher than that of the initial toner, the occurrence of the problem due to a decrease in the fluidity after an elapse of the used time can be suppressed. In addition, by suppressing the fluidity of the initial toner to be low, the occurrence of the problem due to the fluidity of the initial period being too high can be suppressed.

Furthermore, since the amount of the external additive of the initial toner can be increased, as a result, a change in the fluidity from the initial period until an elapse of the used time can be suppressed to be small. In addition, in the replenishment toner, since the amount of the external additive having high fluidity is decreased, the occurrence of the problem due to the accumulation of the external additive after an elapse of the used time can be suppressed. Accordingly, the problems to be solved by this embodiment can be solved.

While there are various methods for measuring the added amount of the external additive, generally, a fluorescent X ray method is used. In other words, a calibration curve is generated by using the fluorescent X ray method for toner of which the added amount of the external additive is known, and an added amount of the additive is acquired by using the calibration curve.

In a case where it is difficult to acquire the added amount of the external additive in detail, the added amount can be checked in a simplified manner by observing the external additives using an transmission electron microscope and measuring and averaging the particle diameter of the external additive and the number of external additives per unit area for 100 particles of toner.

Hereinafter, examples in which specific experiments are made using the configuration of this embodiment and the compositions of the developers of comparative examples compared to each of the examples will be described.

EXAMPLE

Example 1

According to the following prescription, each agent was melted and kneaded by using a biaxial extruder, and the kneaded material was pulverized by using a jet mill and was classified by using an air classifier, whereby toner having an average particle diameter of 5.5 μm was acquired. In a more specific prescription of the toner, resin: 100 wt %, coloring agent: 10 wt %, charge control agent: 1 wt %, and toner parting agent: 5 wt %.

As the external additives, two types of silica powders having mutually-different particle diameters of 0.02 μm and 0.10 μm were used. The silica powders of 0.10 μm serves as a fluidity providing agent and also serves as spacer particles described above.

Regarding the fluidity providing function, the fluidity providing functions of the silica powders of 0.02 μm and the silica powders of 0.10 μm were measured. In this example, toner to which each external additive of 1.0 volume % is added is mixed with a ferrite carrier used as an initial developer to be described later with a T/D ratio of 8%, and the fluidity providing functions were measured by using the repose angle measurement method described above in the state of the two-component developer.

Generally, as the particle diameter of the external additive is smaller, the fluidity providing function becomes higher. However, as a result of the measurement, actually, the angle of repose (the fluidity providing function Fh) of the silica powder of 0.02 μm was 20(°), and the angle of repose (the fluidity providing function Fl) of the silica powder of 0.1 μm was 60(°). Thus, the angle of repose of the silica powder having a smaller particle diameter of 0.02 μm has a smaller angle of repose and a higher fluidity providing function. On the contrary, the angle of repose of the silica powder having a larger particle diameter of 0.1 μm has a larger angle of repose and a lower fluidity providing function.

Generally, as the particle diameter of the external additive is smaller, the toner surface can be covered more densely, and the fluidity providing function becomes higher. Thus, by preparing external additives having mutually-different diameters, two types of external additives having mutually-different fluidity providing functions can be prepared.

Regarding initial toner and an initial developer, an external additive was added to the toner particle according to a prescription described below, and the toner particle and the external additive were mixed by a Henschel mixer for two minutes, whereby the initial toner was acquired. In addition, this initial toner and a ferrite carrier having an average particle diameter of 35 μm were mixed by using a ball mill so as to have a T/D ratio of 8%, and the developer was adjusted. In a specific prescription of the initial toner external addition, 0.02 μm silica powder: 0.5 volume % (=Wh(start)), and 0.10 μm silica powder: 2.0 volume % (=Wl(start)).

Regarding replenishment toner, external additives were added to the toner particle according to a prescription described below, and the toner particle and the external additives were mixed for two minutes by a Henschel mixer, whereby the replenishment toner was acquired. In a specific prescription of the replenishment toner external addition, 0.02 μm silica powder: 1.0 volume % (=Wh(supply)), and 0.10 μm silica powder: 1.0 volume % (=Wl(supply)).

Regarding a total external added amount, the total external added amount of the initial toner is Wh(start)+Wl(start)=0.5+2.0=2.5 volume %, and the total external added amount of the replenishment toner is Wh(supply)+Wl(supply)=1.0+1.0=2.0 volume %. Accordingly, the total external added amount Wh+Wl of the replenishment toner is smaller than that of the initial toner.

Regarding a high fluidity providing external addition ratio, the high fluidity providing external addition ratio of the initial toner is Wh(start)/Wl(start)=0.5/2.0=0.25. In addition, the high fluidity providing external addition ratio of the replenishment toner is Wh(supply)/Wl(supply)=1.0/1.0=1.0. Accordingly, Wh/Wl representing the high fluidity providing external addition ratio of the replenishment toner is higher than that of the initial toner.

Regarding fluidity, in this Example 1, in the initial toner, (Wh(start)/Fh)+(Wh(start)/Fl)=0.5/20+2.0/60≈0.058. In addition, in the replenishment toner, (Wh(supply)/Fh)+(Wl(supply)/Fl)=1.0/20+1.0/60≈0.067. As above, the added amounts of the external additives are adjusted such that the value of (Wh(supply)/Fh)+(Wl(supply)/Fl) representing the fluidity of the replenishment toner is above the value of (Wh(start)/Fh)+(Wl(start)/Fl) representing the fluidity of the initial toner. In this way, the fluidity of the replenishment toner can be set to be higher than the fluidity of the initial toner.

Actually, the initial toner and the replenishment toner were mixed with the ferrite carrier used as an initial developer with a T/D ratio of 8%, and the fluidity was measured by using the repose angle measurement method described above in the state of the two-component developer. As a result, the angle of repose of the initial toner was 24(°), the angle of repose of the replenishment toner was 18(°), and the fluidity of the replenishment toner could be set to be higher than the fluidity of the initial toner.

In the experiment, by using the initial toner and the replenishment toner, consecutive copies of 10,000 sheets were performed for a test image having an image ratio of 2% and a test image having an image ratio of 40%. The evaluation was made for the developer conveyance capability of the developing sleeve, generation of aggregations, and a transition in the toner charging amount (Q/M). At the same time, a transition in the fluidity after the elapse of the used time at an image ratio of 2% and a transition in the accumulated amount of the external additive after the elapse of the used time at an image ratio of 40% are evaluated together. Next, a specific evaluation method will be illustrated below.

Regarding the developer conveyance capability of the developing sleeve, the developer conveyance capability of the developing sleeve for the initial period was evaluated. By performing a visual determination, a case where the amount of the developing sleeve coated with the developer was not stable in a rectangular shape, and non-uniformity was checked was denoted by "x", and a case where non-uniformity was not recognized was denoted by "○".

Regarding the generation of aggregates, a defective image due to the generation of aggregates after an elapse of the used time with the image ratio of 2% was evaluated. By performing a visual determination, a case where the generated aggregate is present in the blade, in other words, an image with a void having a stripe shape in that portion is generated is denoted by "x", and a case where such an occurrence is not recognized is denoted by "○".

Regarding a transition in the toner charging amount (Q/M), after an elapse of the used time with the image ratio of 4%, the amount of a decrease in the toner charging amount (Q/M) after copying 40,000 sheets for the initial period was evaluated. The measurement of the toner charging amount (Q/M) was made using a blow-off method that is the most general method.

Regarding fluidity, the fluidity after an elapse of the used time with an image ratio of 2% was evaluated. The evaluation of the fluidity was performed by sampling the developer that was used and measuring the degree of repose described above.

Regarding an accumulated amount of the external additives, the accumulation of the external additives after an elapse of the used time with an image ratio of 40% was evaluated. The accumulated amount of the external additives was evaluated by performing quantification of the Si amount by using an automatic fluorescent X-ray analysis device. A calibration curve was generated by using a $SiO_2$ standard product, a sample of 10 g was compressed and molded inside a dedicated ring and was decompressed and dried for three hours, and a quantification analysis was performed based on the calibration curve by using the above-described device.

Figure 6A:
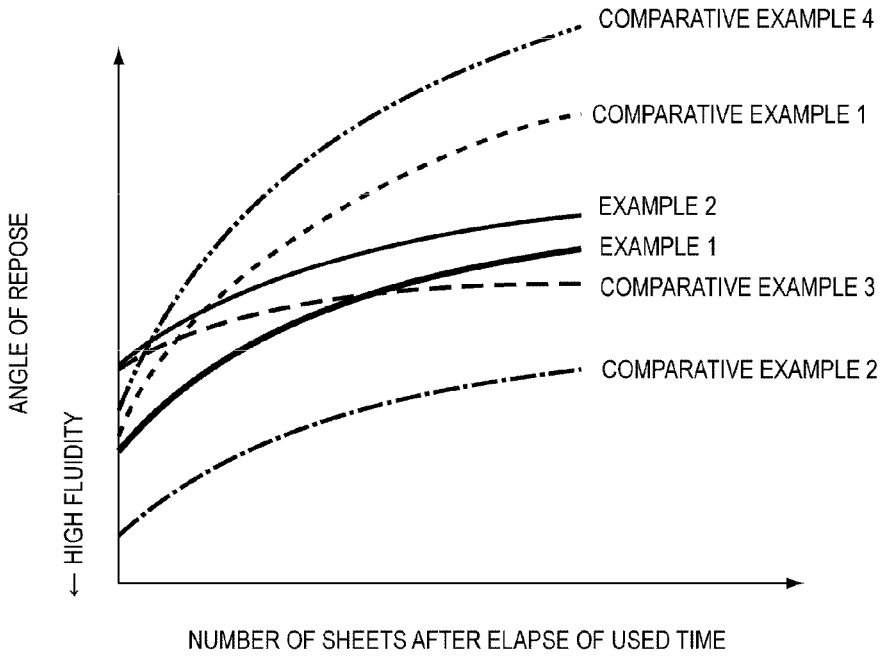
FIGS. 6A and 6B are graphs that compare experimental results of examples and comparative examples.
Figure 6B:
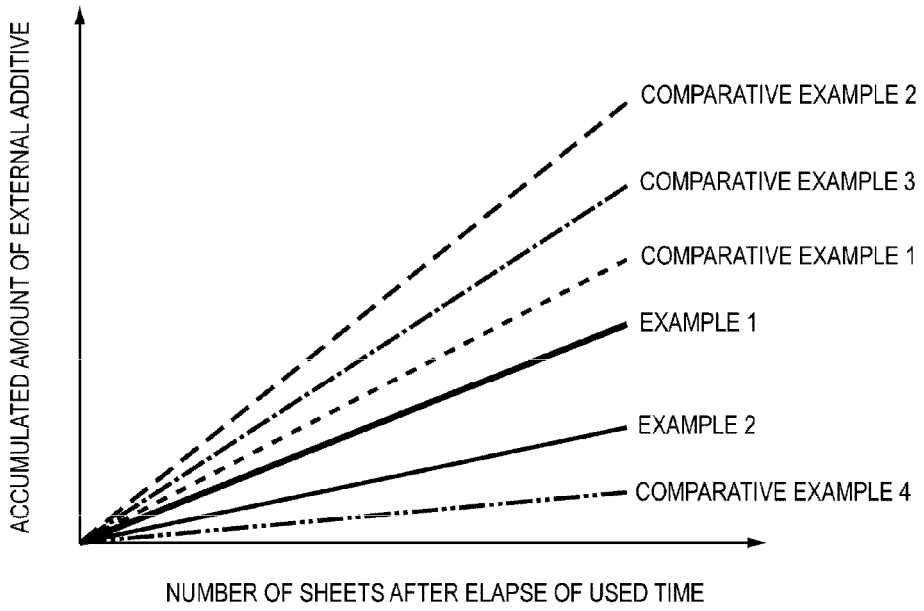

The result of the experiment was illustrated in FIGS. 5, 6A, and 6B. FIG. 5 is a table that compares experimental results of examples and comparative examples. FIGS. 6A and 6B are graphs that compare experimental results of examples and comparative examples. FIG. 6A illustrates a transition in the fluidity after an elapse of the used time with an image ratio of 2%, and FIG. 6B illustrates a transition in the accumulated amount of the external additives after an elapse of the used time with an image ratio of 40%.

In the configuration of this Example 1, by changing the external addition for the initial toner and the replenishment toner, it could be suppressed that the fluidity of the initial toner becomes excessively high. Accordingly, a defect in the developer conveyance capability of the developing sleeve for the initial period did not occur. In addition, since the fluidity of the replenishment toner could be set to be high, the degradation of the fluidity could be suppressed, and there was no generation of aggregates after an elapse of the used time with an image ratio of 2%. At this time, the amount of change in the fluidity could be suppressed to be small as well. In addition, since a total external added amount of the replenishment toner was suppressed to be small, the accumulated amount of the external additives according to an elapse of the used time could be suppressed, and a transition in the toner charging amount (Q/M) after an elapse of the used time with an image ratio of 40% was relatively satisfactory.

Example 2

The same toner particle as that of Example 1 was used. As the external additive, a common silica powder having the same particle diameter as that of the hydrophobized silica powder having an average particle diameter of 0.05 μm was used.

Regarding the fluidity providing function, the fluidity providing functions of the hydrophobized silica powder and the silica powder were measured. Similar to Example 1, the fluidity providing functions were measured by using the repose angle measurement method described above in the state of the two-component developer. Generally, as the hydrophobic treatment is performed for an external additive, the fluidity providing function is improved. As a result of the measurement, the angle of repose (the fluidity providing function Fh) of the hydrophobized silica powder was 15(°), and the angle of repose (the fluidity providing function Fl) of the silica powder was 30(°). Thus, the angle of repose of the silica powder for which the hydrophobic treatment is performed has a smaller angle of repose and a higher fluidity providing function. On the contrary, the angle of repose of the silica powder for which the hydrophobic treatment is not performed has a larger angle of repose and a lower fluidity providing function.

Generally, in a case where the hydrophobic treatment is performed, the fluidity providing function is improved. The reason for this is that, in a case where the hydrophobic treatment is performed, it is difficult for moisture to be adsorbed onto the surface of the external additive, and a liquid bridging force is suppressed. Thus, by preparing external additives having mutually-different hydrophobized states, two types of external additives having mutually-different fluidity providing functions can be prepared. The hydrophobized state can be evaluated by measuring the hydrophobicity using methanol illustrated below. As a result of the measurement, the hydrophobized silica powder has a high hydrophobicity of 80%, and the silica powder has a low hydrophobicity of 30%.

Regarding the hydrophobicity, the measurement of the hydrophobicity using methanol that is used for evaluating the hydrophobicity of fine particles is performed as below. A sample fine particle of 0.2 g is added to water of 50 ml disposed inside a conical flask having a capacity of 250 ml. The methanol is titrated from a burette. At this time, the solution disposed inside the flask is constantly stirred by a magnetic stirrer. The end of the sedimentation of fine particles is checked as the entire amount thereof is suspended in the liquid, and the hydrophobicity is represented as a percentage of methanol with respect to a liquid mixture of methanol and water at a time point of the end of the sedimentation.

The initial toner and the initial developer were prepared according to a prescription described below by using the same method as that of Example 1. In other words, in a prescription of the initial toner external addition, hydrophobized silica powder: 0.2 volume % (=Wh(start)), and silica powder: 1.0 volume % (=Wl(start)).

The replenishment toner was prepared according to a prescription described below using the same method as that of Example 1. In other words, in a prescription of the replenishment toner external addition, hydrophobized silica powder: 0.5 volume % (=Wh(supply)), and silica powder: 0.4 volume % (=Wl(supply)).

Regarding a total external added amount, the total external added amount of the initial toner is Wh(start)+Wl(start)=0.2+1.0=1.2 volume %, and the total external added amount of the replenishment toner is Wh (supply)+Wl(supply)=0.5+0.4=0.9 volume %. Accordingly, the total external added amount Wh+Wl of the replenishment toner is smaller than that of the initial toner.

Regarding a high fluidity providing external addition ratio, the high fluidity providing external addition ratio of the initial toner is Wh(start)/Wl(start)=0.2/1.0=0.2, and the high fluidity providing external addition ratio of the replenishment toner is Wh(supply)/Wl(supply)=0.5/0.4=1.25. Accordingly, Wh/Wl representing the high fluidity providing external addition ratio of the replenishment toner is higher than that of the initial toner.

Regarding fluidity, in this Example 2, in the initial toner, (Wh(start)/Fh)+(Wl(start)/Fl)=0.2/15+1.0/30≈0.035. In addition, in the replenishment toner, (Wh(supply)/Fh)+(Wl(supply)/Fl)=0.5/15+0.4/30≈0.047. As above, the value of (Wh(supply)/Fh)+(Wl(supply)/Fl) of the replenishment toner is set to be larger than the value of (Wh(start)/Fh)+(Wl(start)/Fl) of the initial toner. In this way, the fluidity of the replenishment toner can be set to be higher than the fluidity of the initial toner.

Actually, the initial toner and the replenishment toner were mixed with the ferrite carrier used as an initial developer with a T/D ratio of 8%, and the fluidity was measured by using the repose angle measurement method described above in the state of the two-component developer. As a result, the angle of repose of the initial toner was 28(°), the angle of repose of the replenishment toner was 20(°), and the fluidity of the replenishment toner could be set to be higher than the fluidity of the initial toner.

The exactly same experiment as that of Example 1 was performed, and the evaluation result is illustrated in FIGS. 5, 6A, and 6B. In the configuration of this Example 2, for the same reason as that of Example 1, there is no defect in the developer conveyance capability of the developing sleeve for the initial period and the generation of aggregates after an elapse of the used time with an image ratio of 2%. At this time, the amount of change in the fluidity could be suppressed to be small as well. In addition, a transition in the toner charging amount (Q/M) after an elapse of the used time with an image ratio of 40% was relatively satisfactory.

Comparative Example 1

In comparative Example 1, the exactly same experiment as that of Example 1 was performed by using the initial developer of Example 1 and using the same toner as the initial toner contained in the initial developer as the replenishment toner. The evaluation results are illustrated in FIGS. 5, 6A, and 6B.

In the configuration of this Comparative Example 1, a defect in the developer conveyance capability of the developing sleeve for the initial period does not occur, and a transition in the toner charging amount (Q/M) after an elapse of the used time with an image ratio of 40% was relatively satisfactory.

However, after an elapse of the used time with an image ratio of 2%, an image defect due to aggregates occurs. The reason for this is that, in Comparative Example 1, since the toner having the same external added amount is used as the initial toner and the replenishment toner, the fluidity of the replenishment toner is not that high, and the fluidity decreases according to an elapse of the used time with a low image ratio.

Comparative Example 2

In Comparative Example 2, only the external additives are changed as below. Other than that, the completely same experiment as that of Example 1 was performed by using the initial developer and the replenishment toner that are the same as those of Comparative Example 1. The results of the evaluations are illustrated in FIGS. 5, 6A, and 6B. More specifically, in a prescription of the external addition of the initial toner and the replenishment toner, 0.02 μm silica powder: 1.5 volume % (=Wh(start)=Wh(supply)), and 0.10 μm silica powder: 2.0 volume % (=Wl(start)=Wh(supply)).

Regarding a total external added amount, the total external added amounts of both the initial toner and the replenishment toner are Wh(start)+Wl(start)=Wh(supply)+Wl(supply)=1.5+2.0=3.5 volume %.

Regarding fluidity, the initial toner and the replenishment toner were mixed with the ferrite carrier used as an initial developer with a T/D ratio of 8%, and the fluidity was measured by using the repose angle measurement method described above in the state of the two-component developer. As a result, the fluidity was 14.

In the configuration of this Comparative Example 2, there was no generation of aggregates after an elapse of the used time with an image ratio of 2%. However, a defect in the developer conveyance capability of the developing sleeve for the initial period occurs, and the level of a transition in the toner charging amount (Q/M) after an elapse of the used time with an image ratio of 40% was also degraded. This is considered as below.

In Comparative Example 2, the toner having the same external added amount is used as the initial toner and the replenishment toner, and the external added amount is large, whereby the fluidity according to an elapse of the used time was satisfactory. On the other hand, since the fluidity of the initial toner is excessively high, the defect in the developer conveyance capability occurred. In addition, since a total amount of the external additive of the replenishment toner is also large, the accumulated amount of the external additives increases according to an elapse of the used time, and a transition in the toner charging amount (Q/M) after an elapse of the used time with an image ratio of 40% was also degraded.

Comparative Example 3

In Comparative Example 3, an experiment was performed by using a toner particle, external additives, and a ferrite carrier, which are the same as those of Example 1, using the same method as that of Example 1. However, the added amounts of the external additive are changed as below.

In a prescription of the initial toner external addition, 0.02 μm silica powder: 0.5 volume % (=Wh(start)), and 0.10 μm silica powder: 1.0 volume % (=Wl(start)). In addition, in a prescription of the replenishment toner external addition, 0.02 μm silica powder: 1.0 volume % (=Wh(supply)), and 0.10 μm silica powder: 2.0 volume % (=Wl(supply)).

Regarding a total external added amount, the total external added amount of the initial toner is Wh(start)+Wl(start)=0.5+1.0=1.5 volume %, and the total external added amount of the replenishment toner is Wh(supply)+Wl(supply)=1.0+2.0=3.0 volume %. Accordingly, the total external added amount Wh+Wl of the replenishment toner is larger than that of the initial toner.

Regarding a high fluidity providing external addition ratio, the high fluidity providing external addition ratio of the initial toner is Wh(start)/Wl(start)=0.5/1.0=0.5, and the high fluidity providing external addition ratio of the replenishment toner is Wh(supply)/Wl(supply)=0.5/1.0=0.5. Accordingly, Wh/Wl representing the high fluidity providing external addition ratio is not changed between the initial toner and the replenishment toner.

Regarding fluidity, in this comparative example, in the initial toner, (Wh(start)/Fh)+(Wl(start)/Fl)=0.5/20+1.0/60≈0.042. In addition, in the replenishment toner, (Wh(supply)/Fh)+(Wl(supply)/Fl)=1.0/20+2.0/60≈0.083. Accordingly, it can be expected that the fluidity of the replenishment toner is set to be higher than the fluidity of the initial toner.

Actually, the initial toner and the replenishment toner were mixed with the ferrite carrier used as an initial developer with a T/D ratio of 8%, and the fluidity was measured by using the repose angle measurement method described above in the state of the two-component developer. As a result, the angle of repose of the initial toner was 28(°), the angle of repose of the replenishment toner was 17(°), and the fluidity of the replenishment toner could be set to be higher than the fluidity of the initial toner.

The exactly same experiment as that of Example 1 was performed, and the evaluation result is illustrated in FIGS. 5, 6A, and 6B. In the configuration of this Comparative Example 3, the external added amount is changed between the initial toner and the replenishment toner, and the fluidity of the replenishment toner is lowered with respect to that of the initial toner. Accordingly, there is no defect in the developer conveyance capability of the developing sleeve for the initial period, and there is no generation of aggregates after an elapse of the used time with an image ratio of 2%. However, since the fluidity is increased by increasing the total external added amount of the replenishment toner with respect to the initial toner, the accumulated amount of the external additive after an elapse of the used time increases, and a transition in the toner charging amount (Q/M) after an elapse of the used time with an image ratio of 40% was degraded.

Comparative Example 4

In Comparative Example 4, an experiment was performed by using a toner particle, external additives, and a ferrite carrier, which are the same as those of Example 1, using the same method as that of Example 1. However, the added amounts of the external additive are changed as below. In this Comparative Example 4, different from the case of Example 1, as the external additive, only the 0.02 μm silica powder having a relatively high fluidity providing function is used.

In other words, a prescription of the initial toner external addition is only 0.02 μm silica powder: 1.0 volume % (=W(start)). In addition, a prescription of the replenishment toner external addition is only 0.02 μm silica powder: 0.5 volume % (=W(supply)).

The external added amount of the replenishment toner is smaller than that of the initial toner. Regarding the fluidity, since the external added amount of the replenishment toner is smaller than that of the initial toner, the fluidity is lowered. Actually, the initial toner and the replenishment toner were mixed with the ferrite carrier used as an initial developer with a T/D ratio of 8%, and the fluidity was measured by using the repose angle measurement method described above in the state of the two-component developer. As a result, the angle of repose of the initial toner was 28(°), the angle of repose of the replenishment toner was 40(°), and the fluidity of the replenishment toner was lower than the fluidity of the initial toner.

The exactly same experiment as that of Example 1 was performed, and the evaluation results are illustrated in FIGS. 5, 6A, and 6B. In the configuration of this Comparative Example 4, a defect in the developer conveyance capability of the developing sleeve for the initial period does not occur. In addition, since the amount of the replenishment toner is smaller than that of the initial toner, the accumulated amount of the external additive after an elapse of the used time is small, and a transition in the toner charging amount (Q/M) after an elapse of the used time with an image ratio of 40% was extremely satisfactory. However, since the fluidity of the replenishment toner is lower than that of the initial toner, aggregates were generated after an elapse of the used time with an image ratio of 2%.

As above, according to the present invention, the fluidity of the developer can be maintained while the accumulation of the external additive inside the developer at the time of image formation of a high image ratio is suppressed at the elapse of the used time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-080136, filed Apr. 9, 2014 which is hereby incorporated by reference herein in its entirety.

What is claimed is:

1. An image forming apparatus comprising:

a replenishment toner container which houses toner; and a development device which forms an image by using the toner supplied from the replenishment toner container, wherein at least two types of external additives are added to the toner, wherein, of the two types of external additives, when an added amount of a first external additive is Wh (volume % with respect to the toner) and an added amount of a second external additive is Wl (volume % with respect to the toner), a value of Wh+Wl in initial toner of a developer housed in the development device in advance is larger than a value of Wh+Wl in replenishment toner of a developer housed in the replenishment toner container; and wherein the fluidity of the replenishment toner is higher than the fluidity of the initial toner.

2. The image forming apparatus according to claim 1, wherein a fluidity providing function of the first external additive is higher than a fluidity providing function of the second external additive, and wherein a value of Wh/Wl of the replenishment toner is larger than a value of Wh/Wl of the initial toner.

3. The image forming apparatus according to claim 2, wherein a particle diameter of the first external additive is larger than a particle diameter of the second external additive.

4. The image forming apparatus according to claim 3, wherein hydrophobicity of the first external additive is lower than hydrophobicity of the second external additive.

5. The image forming apparatus according to claim 2, wherein hydrophobicity of the first external additive is lower than hydrophobicity of the second external additive.

6. An image forming apparatus, comprising:

a replenishment toner container which houses toner to which external additives are added; and a development device which forms an image by using the toner supplied from the replenishment toner container, wherein an added amount of external additives added to initial toner of developer previously housed in the development device (volume % with respect to the toner) is larger than an added amount of external additives added to replenishment toner of developer housed in the replenishment toner container (volume % with respect to the toner), and wherein the fluidity of the toner housed in the replenishment toner container to which toner external additives are added is higher than the fluidity of the initial toner to which external additives are added.

* * * * *